United States Patent [19]

Garberi et al.

[11] 4,008,795

[45] Feb. 22, 1977

[54] REMOVABLE CARTRIDGE FOR THE INKED RIBBON FOR TYPEWRITERS, CALCULATING MACHINES OR OTHER OFFICE MACHINES

[75] Inventors: Sergio Garberi; Lorenzo Bertino, both of Ivrea (Turin), Italy

[73] Assignee: Ing. C. Olivetti & C., S.p.A., Ivrea (Ivrin), Italy

[22] Filed: June 4, 1975

[21] Appl. No.: 583,693

Related U.S. Application Data

[62] Division of Ser. No. 299,379, Oct. 20, 1972, Pat. No. 3,889,795.

[52] U.S. Cl. ..... 197/161; 197/151; 197/164

[51] Int. Cl.² ..... B41J 33/512

[58] Field of Search ..... 197/160, 163, 164, 161, 197/153, 151

[56] References Cited

UNITED STATES PATENTS

| | | | |
|---|---|---|---|
| 1,114,494 | 10/1914 | Little | 197/164 |
| 2,902,136 | 9/1959 | Whippo | 197/165 |
| 3,513,957 | 5/1970 | Ricciardi et al. | 197/151 |
| 3,542,183 | 11/1970 | Stiffler | 197/165 |
| 3,786,906 | 1/1974 | Okabe | 197/161 |

*Primary Examiner*—Edgar S. Burr
*Assistant Examiner*—William Pieprz
*Attorney, Agent, or Firm*—Schuyler, Birch, Swindler, McKie & Beckett

[57] ABSTRACT

A ribbon feed mechanism for the inked ribbon of a printing machine comprises two ribbon-carrying spools rotatably supported in a removable cartridge and two sensing levers which extend through a pair of apertures in the cartridge to sense the amount of inked ribbon on the spools. The sensing elements cooperate with corresponding latches for retaining a reversal member against the action of a reversal spring which biases the reversal member from a first position to a second position. The reversal member supports two freely rotatable pinions which are moved by the reversal member, as it moves into the first and second positions, into mesh respectively with corresponding spool gears coupled to the two spools and with two gears driven by a feed element in opposite directions. The spools are therefore alternately driven first in one direction and then the other direction respectively. A reload element, responsive to the movement of the reversal member, is driven by the feed element to reposition an end of the reversal spring to bias the reversal member from the first position to the second position and vice-versa.

8 Claims, 8 Drawing Figures

Fig. 2
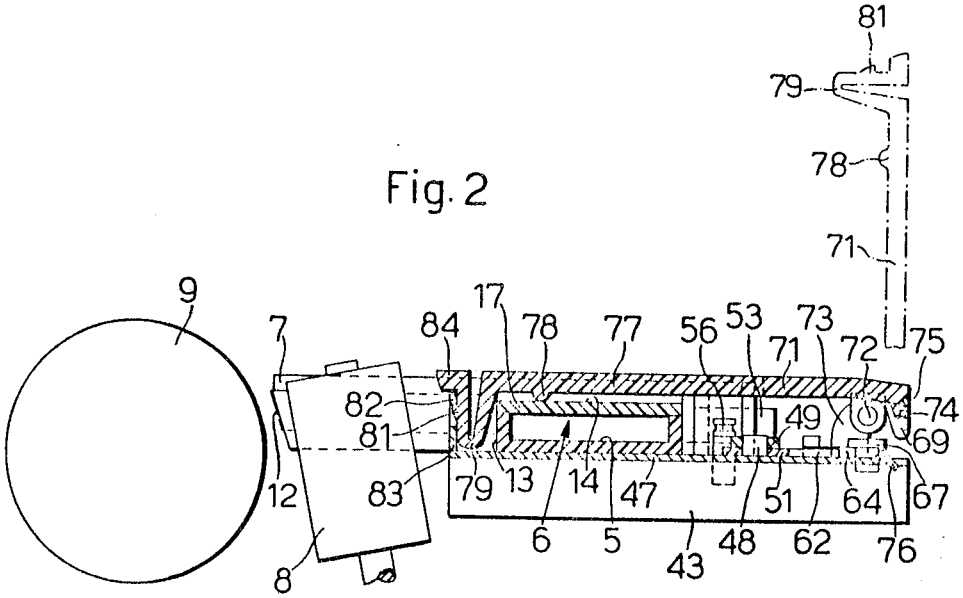
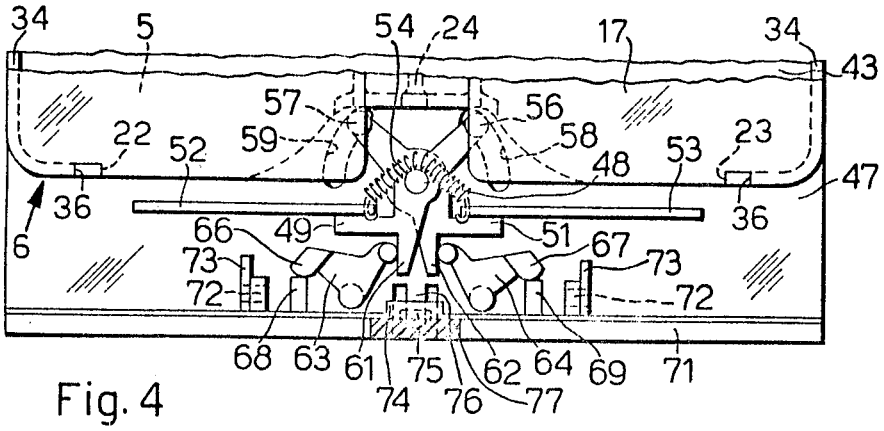
Fig. 4

REMOVABLE CARTRIDGE FOR THE INKED RIBBON FOR TYPEWRITERS, CALCULATING MACHINES OR OTHER OFFICE MACHINES

This is a division of application Ser. No. 299,379, filed Oct. 20, 1972, now U.S. Pat. No. 3,889,795.

BACKGROUND OF THE INVENTION

The present invention relates to a removable cartridge for the inked ribbon for typewriters, calculating machines or other office machines, comprising a container and two ribbon-carrying spools rotatable therein in either direction, the container having at least one main wall to which the axes of both spools are perpendicular, a series of side walls perpendicular to the main wall and a pair of slits in one of the side walls for the passage of the inked ribbon from the one to the other of the spools along a path which, between the slits, lies outside the container.

Cartridges for an inked ribbon are known which are provided with a closed container, in which the ribbon-carrying spools rotate in both directions under the action of a reversal mechanism. The reversal mechanism of the machine is provided with a pair of sensing elements fulcrumed internally on the entrainment pins for the spools. Each sensing element is thrust from the inside against the ribbon coils wound on to the spool, through an aperture in the pin and an aperture in the core of the spool. The sensing elements then control the reversal of the movement of the ribbon, when the number of coils of wound ribbon on a spool is no longer sufficient to hold the sensing element in. The use of sensor elements of this type, however, makes the reversal mechanism for the ribbon rather complicated and costly to realise.

Also known are typewriters which are provided with a reversal mechanism for the movement of the ribbon controlled by a sensor element which rests from the outside on the ribbon coils of the feed spool or of the take-up spool. The sensor element thus tests the quantity of wound ribbon, ordering the reversal when this quantity is less than a pre-established minimum number of coils, or else when it is greater than a maximum number of coils which is likewise pre-established. This reversal mechanism is very simple and therefore economical, but requires, for the replacement of a used ribbon, that the sensor element be pulled away from the relative spool, so as to allow the spool to be pulled off its pin. It is therefore not possible to use ribbon-carrying cartridges of known type, which have closed containers that do not allow the use of sensor elements which test externally the quantity of ribbon wound on the spools.

SUMMARY OF THE INVENTION

In accordance with the present invention, there is provided a removable cartridge for the inked ribbon for an office machine, comprising a container and two ribbon-carrying spools rotatable therein in either direction of rotation, the container having at least one main wall to which the axes of both spools are perpendicular, a series of side walls perpendicular to the main wall, a pair of slits in one of the side walls for the passage of the ribbon from the one to the other of the spools along a path which, between the slits, lies outside the container, and a pair of apertures in a side wall opposite the said one wall, each of the said apertures being associated with one of the spools and being adapted to allow entry into the container of sensing elements for sensing the amount of inked ribbon on the spools.

The invention further provides an office machine incorporating such a cartridge, means releasably attaching the cartridge to the machine, and a ribbon reversal mechanism including two sensing elements which enter the two apertures respectively and bear against the inked ribbon on the two spools respectively.

The closure member can comprise a closure member pivotally mounted on the machine for movement between a first position in which it holds the cartridge on the machine and a second position in which the cartridge is free to be taken off the machine, the closure member being arranged to act on the sensing elements through a coupling mechanism such that, when the closure member is in the second position, the sensing elements are withdrawn from the apertures.

The cartridge in accordance with the invention is simple and economical. This cartridge allows use of a simple attaching means and a simple reversal mechanism for the movement of the ribbon which, in combination with the cartridge, realise an economical and reliable whole.

BRIEF DESCRIPTION OF THE DRAWING

A preferred embodiment of the invention is described by way of example in the following description with reference to the accompanying drawing, in which:

FIG. 2 is a partial section in accordance with the line II—II of FIG. 1;

FIG. 4 is a partial plan view of the cartridge in a special position of the detail of FIG. 1;

DESCRIPTION OF A PREFERRED EMBODIMENT

Figure 1:
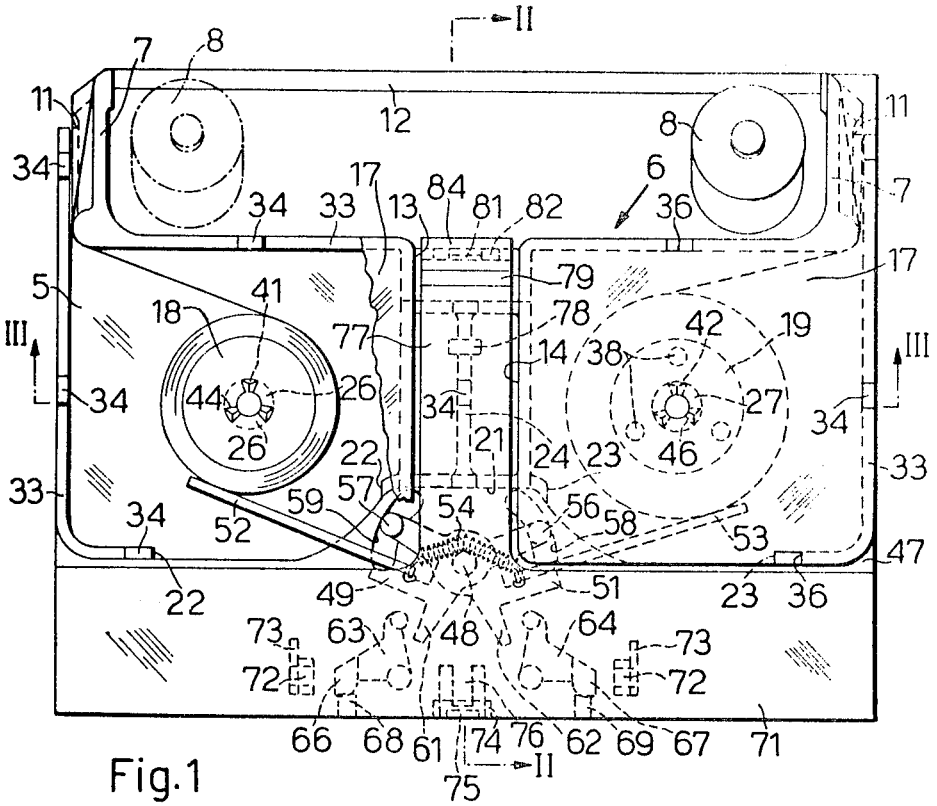
FIG. 1 is a partial plan view of a cartridge for the inked ribbon embodying the invention and of a detail of a calculating machine on which the cartridge is mounted.

With reference to FIG. 1, the cartridge 6 for the inked ribbon 12 comprises a container 5 of plastic material having a substantially parallelpipedal shape. The container 5 is provided at the rear side with two arms 7 which embrace a cylindrical writing head 8 of a calculating machine. The head 8 is movable between the arms 7 from a position of rest indicated in a solid line to an end-of-line position indicated in chain-dotted lines, in order to write a line of print on a tally roll 9 (FIG. 2). An inked ribbon 12 (FIG. 1) is tensioned between the ends of the arms 7 which are suitably shaped and inclined to present the ribbon 12 parallely to the line of print on the tally roll 9 (FIG. 2) and at the right angle (FIG. 1) with respect to, the ribbon 12 emerging from the container 5 through two slits 11 adjacent the arms 7.

Figure 3:
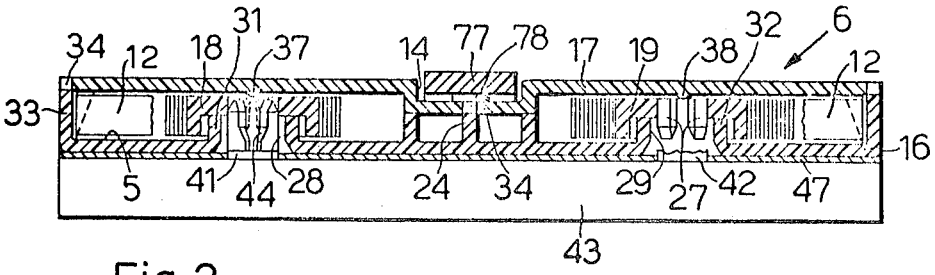
FIG. 3 is a partial section in accordance with the line III—III of FIG. 1.

The container 5 is closed at the top by a lid 17 and has, in the rear part, a central recess which defines a space 13, which is connected to a space 14 (FIG. 3) formed by a channel-like depression in the lid 17. The container 5 (FIG. 1) is provided, in the front side, with a central recess which forms a space 21 and with two apertures 22 and 23 through its front side wall. The container 5 also has central ribbing 24, in line with the spaces 13, 14 and 21, which divides it into two equal chambers, in which two spools 18 and 19 are rotatably mounted.

The spools 18 and 19 store the wound inked ribbon 12 and rotate in the container 5 so as to convey the ribbon 12 from the one spool to the other over the arms 7 and through the slits 11. Each spool 18 and 19 has the shape of a cup turned upside down and is provided with a central hole surrounded by a toothed crown 26 or 27 respectively.

The crowns 26, 27 have three teeth which are lodged in a hole 28 (FIG. 3) or 29 respectively, formed in a lower portion 16 of the container 5. The hole 28 or 29 is defined by a sleeve 31 or 32 which protrudes inside the container 5. On each sleeve 31, 32 there normally rests the base of the spool 18 or 19.

The container 5 has, on its walls 33 and on the central ribbing 24, lugs 34 (FIG. 1) which engage in as many slots 36 in the lid 17, in order to fix the lid 17 to the container 5. Internally the lid 17 has hemispherical pips 37 and 38 (FIG. 3) overlying the spools 18 or 19. The pips 37, 38 are arranged at 120° one to the other and do not allow the spools 18, 19 to rise from the respective sleeves 31, 32 during the rotation for the advance of the inked ribbon 12.

Two revolving shafts 41 and 42 are mounted on a horizontal base 43 of the machine. The shafts 41 and 42 are connected to an advance and reversal device for the movement of the inked ribbon 12 contained inside the base 43 and which will be described subsequently. These shafts 41 and 42 are shaped at the top so as to have in their ends three incisions in the form of an inverted pyramid 44 or 46 respectively (FIG. 1) capable of engaging with the teeth of the crowns 26 and 27 presented by the spools 18 and 19 respectively.

Above the base 43 (FIG. 2) and fixed thereto there is arranged a horizontal platform 47, on which rests the cartridge 6. Fixed on the platform 47 there is a pin 48, about which there are fulcrumed two sensing elements 49 and 51 (FIG. 1) of the reversal mechanism for the inked ribbon 12. These sensing elements 49, 51 comprise a pair of scissor levers 52 and 53 which, under the action of a spring 54, normally rest on the inked ribbon 12 wound on the spools 18 and 19, at the same time keeping the coils tight on the spools 18 and 19. The spring 54 is fixed with its ends in corresponding holes of the levers 52 and 53 and is tensioned at its central portion round the pin 48.

Fixed on the sensing elements 49 and 51 are corresponding pins 56 and 57, which cooperate through slotted holes 58 and 59 in the platform 47 with a latch lever 121 or 122 (FIG. 7) of the mechanism for control of the reversal of the movement of the inked ribbon 12 contained in the base 43. Each sensing element 49, 51 (FIG. 1) has a tongue 61, 62 respectively, with which a releasing device 63, 64 respectively can cooperate. The two releasing devices 63, 64 are fulcrumed on the platform 47 and each has a projection 66, 67 respectively, capable of cooperating with a cam 68 and 69 respectively. These cams are constituted by lugs projecting at the bottom and on the front side of a closure plate 71 of an inverted T-shape.

The closure plate 71 is made of plastic material and is pivoted on two pins 72 on two tongues 73 of the platform 47. The closure plate 71 can thus be swung up to the open, broken line position of FIG. 2. In its front edge the closure plate 71 (FIG. 2) has a central projection 74, in which there is made a V-incision 75 capable of cooperating with a leaf spring 76 integral with the platform 47, when the closure plate 71 is rotated by 90° into the open position.

The closure plate 71 includes on the rear side a tongue 77, which is lodged in the space 14 (FIG. 3) of the lid 17, and a lower projection 78 keeps the cartridge 6 in contact with the platform 47.

The tongue 77 ends with a downwardly bent projection 79 (FIG. 2) in the form of a "V" which is lodged in the rear space 13 of the container 5. The projection 79 has, at the rear, a detent lug 81 capable of engaging with a shoulder 82 presented by a tongue 83 of the platform 47. The projection 79 has, furthermore, a rear ledge 84 substantially coplanar with the tongue 77 by means of which, taking advantage of the elasticity of the material, and by exerting a slight manual pressure, one can engage or disengage the detent lug 81 from the shoulder 82. The space 13 of the container 5 allows the tongue 83 to remain substantially aligned with the rear wall of the container 5 (FIG. 1) and outside the zone of rectilinear movement of the head 8.

To replace a used cartridge 6 by a new one, one acts in the following manner. With one hand one exerts a slight pressure on the ledge 84 (FIG. 2) of the projection 79 in order to disengage the detent lug 81 from the shoulder 82 and then one swings up the closure plate 71. The cams 68 (FIG. 1) and 69 bear against the respective projections 66 and 67 of the releasing devices 63 and 64 respectively, causing these devices 63 and 64 to rotate, the first device 63 in the clockwise direction and the second device 64 in the anticlockwise direction. Each releasing device 63, 64 engages the tongue 61 and 62 of the respective sensing element 49, 51. The two sensing element 49, 51 rotate, the first sensing element 49 in the anticlockwise direction and the second sensing element 57 in the clockwise direction against the action of the spring 54.

After a rotation of about 90° of the closure plate 71, the leaf spring 76 engages in the incision 75. The releasing devices 63 and 64 have rotated the levers 52 and 53 of the sensing elements 49 and 51 out of the container 5, arranging them aligned in accordance with one and the same plane parallel to the shafts 41 and 42 as shown in FIG. 4. The closure plate 71 is then in the vertical position and the sensing elements 49 and 51 are disconnected from the cartridge 6, allowing the removal from the platform 47 of the cartridge 6.

The used cartridge 6 is then lifted off with one hand and is replaced by another one by resting this latter on the platform 47 so as to bring the crowns 26 and 27 (FIG. 1) into engagement with the shafts 41, 42. One then flaps down the closure plate 71 overcoming the resistance of the leaf spring 76.

The spring 54 causes the sensing elements 49 and 51 to rotate, the first sensing element 49 in the clockwise direction and the second sensing element 51 in the anticlockwise direction. The levers 52 and 53 pass through the apertures 22 and 23 of the container 5 and rest on the coils of inked ribbon 12 wound on the two spools 18 and 19. By now exerting a slight pressure downwards on the ledge 84 of the projection 79, the detent lug 81 snaps under the shoulder 82 of the tongue 83 (FIG. 2). The lower projection 78 of the tongue 77 is lodged in the space 14 (FIG. 3) of the lid 17 and keeps the cartridge 6 against the platform 47 through the elasticity of the tongue 77, and therefore in this way fixed removably to the machine. The two releasing devices 63 and 64 (FIG. 1) rotate loosely and remain inactive during the functioning of the reversal mechanism for the inked ribbon 12.

During the change of the cartridge 6, the stretch of inked ribbon 12 which projects out from the arms 7 is not in tension, because the spools 18 and 19 may have been rotated slightly in the clockwise or anticlockwise direction by the incisions 44 and 46 during the engagement with the crowns 26 and 27. Nevertheless, no sooner does the writing cycle begin than the inked ribbon 12 is brought rapidly into tension. During the functioning the levers 52 and 53 exert a certain restraining pressure on the coils of the inked ribbon 12.

Figure 5:
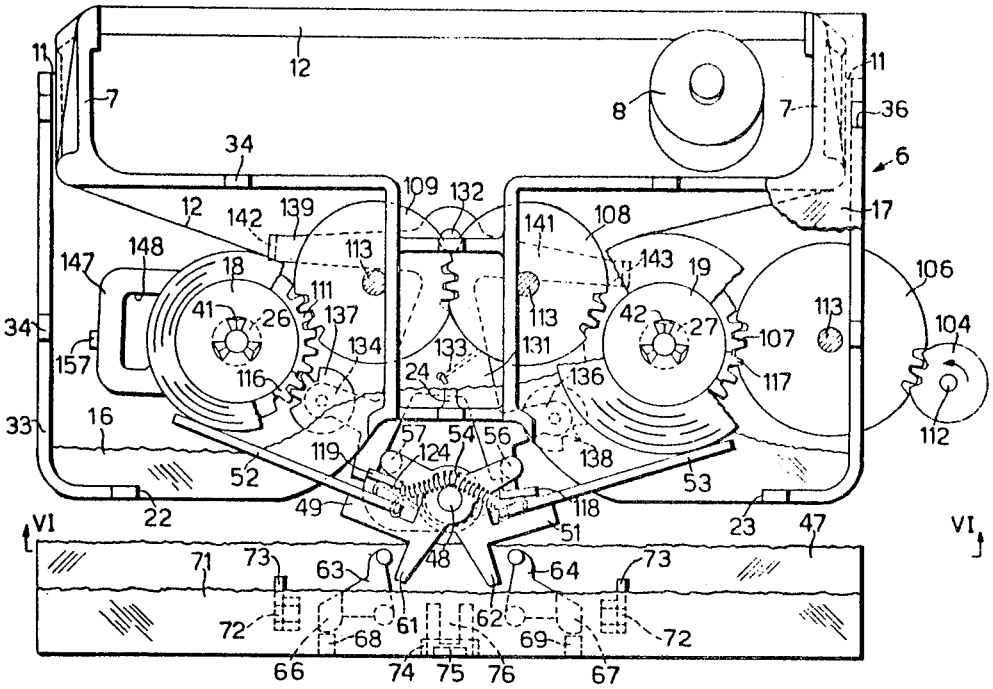
FIG. 5 shows a partial plan view of the cartridge of FIG. 1 with another detail of the calculating machine.
Figure 6:
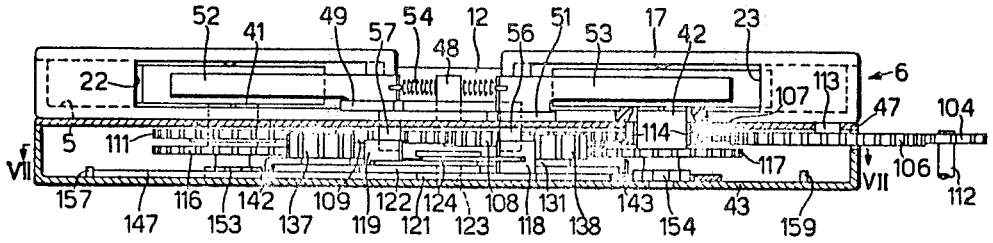
FIG. 6 shows a section in accordance with the line VI—VI of FIG. 6 of some details of FIG. 5.

With reference to FIG. 5, the reversal mechanism for the feed movement of the inked ribbon 12 comprises a series of flat gears 104, 106, 107, 108, 109 and 111 always in mesh one with another. The gear 104 is integral with a driving shaft 112 of the calculating machine always revolving in the anticlockwise direction. The gears 106, 108 and 109 are rotary on axes 113 fixed below the platform 47 (FIG. 6). The gears 107 and 111 are rotary on sleeves 114, they too fixed at the bottom to the platform 47. Two gears 116, 117, similar to the gears 111 and 107 respectively, are in one piece with the shafts 41 and 42 respectively, which are rotatable in the sleeves 114. The gears 116 and 117 are arranged below the gears 111 and 107.

Each sensing element 49, 51 is adapted to cooperate through its pin 56 or 57 with a tongue 118 or 119 respectively of the corresponding latch lever 121 or 122 (FIG. 7), both levers 121 and 122 being fulcrumed on a pin 123 fixed on the base 43. A coil spring 124, fitted over the pin 123, has its ends bearing against the tongues 118 and 119 so as to thrust the lever 122 in the clockwise direction and the lever 121 in the anticlockwise direction about the pin 123. Under the action of the coil spring 124, each tongue 118, 119 will be arrested either on a front shoulder 128 or 129 respectively or on a rear shoulder 120 or 125 respectively of a reversal member 131.

The reversal member 131 is constituted by a rocker fulcrumed on a pin 132 fixed on the base 43. The rocker 131 can move from a first position shown in FIG. 7 to a second position shown in FIG. 8 and vice versa, under the action of a coiled expansion spring 133. The rocker 131 (FIG. 7) has two lugs 134 and 136 on each of which there is loosely revolving a pinion 137 or 138 respectively. Each pinion 137, 138 is capable of engaging selectively with the gear 111 (FIG. 6) or with the gear 107, in order to connect the gear 111 with the gear 116 and the gear 107 with the gear 117.

The rocker 131 is provided with two arms 139 (FIG. 7) and 141, each of which has a tongue 142 and 143 respectively. Each tongue 142, 143 can cooperate with a cam part 144 or 146 respectively of a reload element 147.

The reload element 147 is constituted by a sliding plate having a generally rectangular shape and which rests on the bottom of the base 43. The reload element 147 has two windows 148 and 149 in which there are formed rack teeth 151 or 152 respectively arranged in the same horizontal plane. The teeth 151, 152 can engage with a pinion 153 or 154 respectively which is in one piece with the shaft 41 and 42 respectively and hence with the gear 116 or 117 respectively.

The coiled expansion spring 133 is connected at one end to the rocker 131 and at the other end to the reload element 147. In the first position of the rocker 131 and of the reload element 147 of FIG. 7, the tongue 118 of the lever 121 is stopped against the front shoulder 128, whilst the tongue 119 of the lever 122 is stopped against the rear shoulder 125 of the rocker 131. The tension of the coiled expansion spring 133 is such as to keep the rocker 131 stopped with a lateral shoulder 127 against the tongue 119. The reload element 147 is, in its turn, urged by the coiled expansion spring 133 against two stops 156 and 157 of the base 43 and with the pinion 153 adjacent to but disengaged from the teeth 151. In the second position of the rocker 131 and of the reload element 147 of FIG. 8, the tongue 118 of the lever 121 is stopped against the rear shoulder 120 and the tongue 119 is stopped against the front shoulder 129. The tension of the coiled expansion spring 133 keeps the rocker 131 stopped with a lateral shoulder 126 stopped against the tongue 118. The reload element 147 is, in its turn, stopped against two fixed stops 158 and 159 of the base 43 and with the pinion 154 adjacent to but disengaged from the teeth 152.

Figure 7:
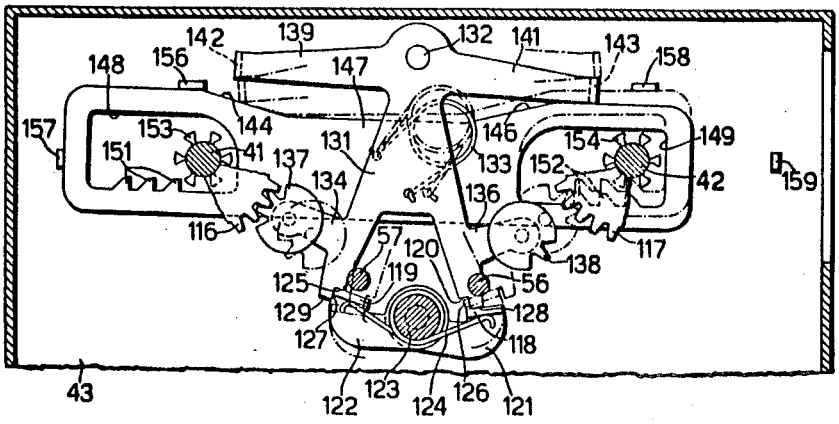
FIG. 7 shows a section in accordance with the line VII—VII of FIG. 6 of some details of FIG. 5.
Figure 8:
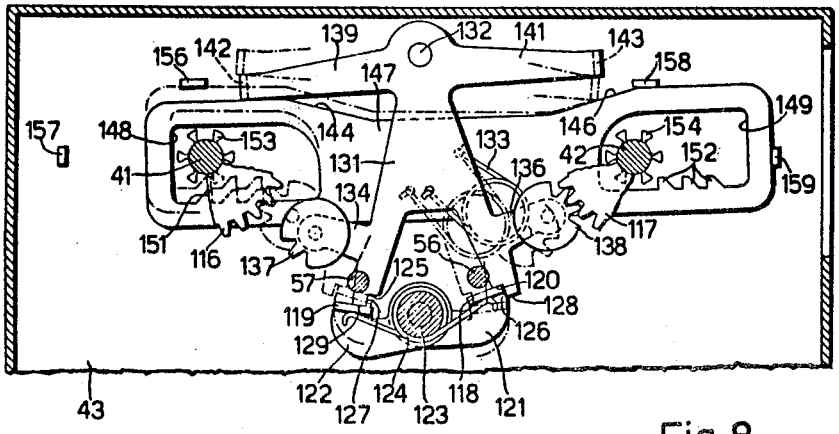
FIG. 8 shows the details of FIG. 7 in a second operative position.

In operation it will be assumed that the rocker 131 and the reload element 147 are in the first position as shown in FIGS. 5, 6 and 7, in which the pinion 137 meshes with the gears 111 and 116. The gear train from 104 to 111 then causes the ribbon 12 to wind on to the spool 18, whereby the ribbon 12 shifts from the right to the left in FIG. 5. The lever 52 withdraws the pin 56 from the tongue 118 against the action of the spring 54. On the contrary, the pin 57 of the lever 53 approaches the tongue 119 under the action of the spring 54. The inked ribbon 12 continuing to unwind from the spool 19, the lever 53 progressively approaches towards the center of the spool 19 whereby the pin 57 engages the tongue 119 and begins to cause the lever 122 (FIG. 7) to rotate in the anticlockwise direction against the action of the coil spring 124, over which the spring 54 (FIG. 5) prevails. When the coils of inked ribbon 12 wound on the spool 19 are less than a prefixed quantity, the tongue 119 disengages from the lateral shoulder 127 (FIG. 7), whereby the coiled expansion spring 133 causes the rocker 131 to rotate rapidly in the anticlockwise direction. The rocker 131 passes from the first position to the second one, placing itself in the position shown by broken lines in FIG. 7. The tongue 118 in its turn, under the action of the coil spring 124, then stops on the rear shoulder 120, whilst the tongue 119 remains rested against the pin 57, until the coils of inked ribbon 12 (FIG. 5) increase on the spool 19, whereby the lever 53 draws away radially and therefore the tongue 119 engages the front shoulder 129 (FIG. 8). The pinion 137 ceases to engage the gears 111 (FIG. 5) and 116, thereby stopping temporarily the shaft 41. The pinion 138 then meshes with the gears 107 and 117, whereby the shaft 42 can rotate.

At the same time the tongue 143 (FIG. 7) ceases its engagement with the cam part 146 and the tongue 142 engages with the cam part 144. The coiled expansion spring 133 assumes a second position shown in broken lines, causing the reload element 147 to shift backwards until this latter is stopped against the fixed stop 158 as shown in broken lines in FIG. 7. The teeth 152 therefore come into mesh with the pinion 154.

Because of the rotation of the gears from 104 to 107 (FIG. 5) the pinion 138 transmits the movement to the gear 117, and thence to the shaft 42, whereby the inked ribbon 12 starts to wind on to the spool 19. At the same time the pinion 154 (FIG. 7), which is rotating in the anticlockwise direction, meshes with the teeth 152 and shifts the reload element 147 towards the right until it stops against the fixed stop 159. During this displacement, the tongue 142, through the cam part 144, shifts the left hand end of the reload element 147 forwards, so as to prevent the teeth 151 from encountering the teeth of the pinion 153. With this displacement, the various elements assume the stable configuration of FIG. 8 already described, whereby the coiled expansion spring 133 now tends to urge the rocker 131 back from the position of FIG. 8 to that of FIG. 7.

The inked ribbon 12 (FIG. 5) continues to wind on to the spool 19, whereby the lever 53 moves radially against the action of the spring 54, drawing away from the center of the spool 19 and drawing the pin 57 away from the tongue 119. The lever 52 moves on the contrary radially under the action of the spring 54 towards the center of the spool 18 and moves the pin 56 towards the tongue 118. Eventually the pin 56 engages the tongue 118, causing the lever 121 (FIG. 8) to rotate in the clockwise direction against the action of the coil spring 124 until the tongue 118 ceases to engage the lateral shoulder 126. The coiled expansion spring 133 then causes the rocker 131 to rotate rapidly in the clockwise direction, thereby to pass from the second position to the first position as shown by broken lines in the FIG. 8. The coiled expansion spring 133 assumes the position shown in broken lines in FIG. 8.

The pinion 138 disengages from the gears 107 and 117 (FIG. 5), whereby the shaft 42 ceases to rotate, and the pinion 137 meshes with the gears 111 and 116. The tongue 142 (FIG. 8) disengages from the cam part 144 whilst the tongue 143 engages the cam part 146. The coiled expansion spring 133 shifts the reload element 147 backwards until it stops against the stop 156 as shown by broken lines in FIG. 8. The teeth 151 mesh with the pinion 153. The tongue 119, under the action of the coil spring 124, engages with the rear shoulder 125, whilst the tongue 118 remains rested against the pin 56, until the coils of inked ribbon 12 (FIG. 5) wound on the spool 18 increase, when the lever 52 withdraws radially and hence the tongue 118 engages the front shoulder 128 (FIG. 8).

Through the rotation of the gears from 104 (FIG. 5) to 111, the pinion 137 transmits the movement to the gear 116 and hence to the shaft 41 whereby the inked ribbon 12 resumes its winding on the spool 18. At the same time the pinion 153 (FIG. 8), by rotating in the clockwise direction, meshes with the teeth 151 and shifts the reload element 147 until it stops against the fixed stop 157. During this displacement the tongue 143, engaging the cam part 146, moves the right hand end of the reload element 147 forwards so that the teeth 152 do not encounter the teeth of the pinion 154. The various elements therefore resume the stable configuration of FIG. 7.

We claim:

1. A ribbon feed mechanism for an inked ribbon for a printing machine comprising: two spools carrying said ribbon, a pair of sensing elements for sensing the amount of said ribbon on said spools, a feed element, a reversal member positionable in a first and a second position, means supported by said reversal member and driven by said feed element to drive said ribbon spools in one direction and in the opposite direction according to said first and said second position of said reversal member, respectively, a reversal spring having one end connected to said reversal member and the other end positionable between a first location and a second location, said reversal spring biasing said reversal member from said first position towards said second position in said first location of said other end and from said second position towards said first position in said second location of said other end, two latches, each said latch positionable between an engaging position and a releasing position for restraining and releasing respectively said reversal member in said first and second positions thereof against the action of said reversal spring, means connecting each of said latches with one of said sensing elements for moving said latches from said engaging position to said releasing position in order to disengage said reversal member therefrom when the ribbon on the corresponding spool has reached a quantity such as to require reversal of the ribbon feed, whereby said reversal spring moves said reversal member from said first position to said second position and vice-versa, and a reload element responsive to said movement of said reversal member, said reload element driven by said feed element for repositioning said other end of said reversal spring from said first location to said second location, and vice-versa, to respectively bias said reversal member from said second position to said first position, and vice-versa.

2. A ribbon feed mechanism according to claim 1, further comprising: two shoulders on said reversal member, each said shoulder corresponding to one of said latches, spring means biasing said latches from said releasing position to said engaging position to bear said latches against said corresponding shoulders of said reversal member, so that, in each of said first or second positions of said reversal member, at least one of said latches engages said corresponding shoulder to prevent movement of said reversal member to said second or first position, respectively, said sensing elements being pushed by a sensing spring to bear against the ribbon on the corresponding spools, each said sensing element carrying a projection for pushing said one latch out of engagement with the said corresponding shoulder when the ribbon on the corresponding spool has unwound to a predetermined extent, said sensing spring on each of said sensing elements being stronger than said spring means on said latches whereby the action of said sensing elements in disengaging said latches prevails over the action of said latches.

3. A ribbon feed mechanism according to claim 1, wherein said reload element is supported along a first direction between a first and a second position corresponding to said first and second position of said reversal member and wherein said reload element is supported for a movement along a second direction, further comprising motive means driven by said feed element, said motive means engageable with said reload element to move said reload element along said first direction, and means on said reversal member holding said reload element shifted along said second direction against the action of said reversal spring out of engagement with said motive means, whereby the movement of said reversal member from said first position to said second position causes said reversal spring to move said reload element along said second direction into engagement with said motive means to cause said reload element to be driven from said first position to said second position and vice-versa.

4. A ribbon feed mechanism according to claim 3, wherein said motive means comprises a pinion and said reload element comprises a reload plate slidable between its first and second position along said first and said second directions and bearing a rack engageable with said pinion for effecting movement of said plate.

5. A ribbon feed mechanism according to claim 4 wherein said spools are engageable on corresponding pins, and wherein said reload plate has two racks and said motive means comprises two pinions attached respectively with said pins, said racks being engageable with said pinions.

6. A ribbon feed mechanism according to claim 1, wherein said feed element includes a rotatable drive shaft, and further comprising two spool gears coupled to said two spools, respectively, and a train of further gears rotatable by said drive shaft in a single direction, said further gears including two oppositely rotating motive gears being parallel to and coaxial with said two spool gears, respectively, wherein said means supported by said reversal member comprise two pinions freely rotatable on said reversal member, whereby said reversal member, in each of said first and second position, holds one of said pinions into mesh with one corresponding spool gear of said spool gears and with one corresponding motive gear of said further gears to drive said spool gear.

7. In a ribbon feed mechanism for an inked ribbon for a printing machine comprising a pair of spools carrying said ribbon, a pair of sensing levers for sensing the amount of said ribbon on said pair of spools, a feed element, a reversal member positionable in a first and in a second position under the control of said sensing levers, and means operated by said reversal member in said first and in said second position thereof for connecting said feed element with said pair of spools for driving the ribbon in one direction and in the opposite direction, respectively, the combination comprising: a pair of spool gears fixed to said spools for the driving thereof; a train of further gears continuously rotated by said feed element in a single direction, said train of gears comprising a pair of oppositely rotating motive gears parallel to and coaxial with said pair of spool gears, respectively and; at least one pinion rotatably supported by said reversal member, said reversal member in said first or in said second position carrying said at least one pinion into mesh with either one or the other of said pair of spool gears and one or the other of said pair of motive gears for the driving of said spools in one direction or in the opposite direction respectively.

8. A ribbon feed mechanism according to claim 7, further comprising: a reversal spring having one end connected to said reversal member and the other end positionable between a first and a second location for biasing said reversal member from said first position towards said second position in the first location of said other end and from said second position towards said first position, respectively, in the second location of said end; a pair of latches positionable between an engaging position and a releasing position, for restraining and releasing respectively said reversal member against the action of said spring, each of said latches causing said pinion to be positively engaged with one or the other of said pair of spool gears and said pair of motive gears; and means connecting said sensing levers with said latches for the movement thereof from said engaging position to said releasing position for disengaging said reversal member when the ribbon has reached a quantity such as to require reversal of the ribbon feed, whereby said reversal spring moves said reversal member from the first position to the second position carrying said at least one pinion out of mesh with said one of said pairs of spool gears and motive gears, and into mesh with the other of said pairs of spool gears and motive gears.

* * * * *